United States Patent [19]

Nagano et al.

[11] 4,201,650

[45] May 6, 1980

[54] APPARATUS FOR CONTINUOUS ELECTROLYTIC DESCALING OF STEEL WIRE WITH MILL SCALES

[75] Inventors: Hiroo Nagano; Takashi Fukuda, both of Kobe; Hiroshi Nagai; Yasuyuki Nakamura, both of Amagaski, all of Japan

[73] Assignee: Sumitomo Metal Industries, Ltd., Osaka, Japan

[21] Appl. No.: 886,572

[22] Filed: Mar. 14, 1978

[30] Foreign Application Priority Data

Mar. 22, 1977 [JP] Japan ..... 52/31901
Mar. 22, 1977 [JP] Japan ..... 52/31902

[51] Int. Cl.[2] ..... C25F 7/00; C25F 1/00

[52] U.S. Cl. ..... 204/209; 204/206; 204/272

[58] Field of Search ..... 204/206–211

[56] References Cited

U.S. PATENT DOCUMENTS

| | | | |
|---|---|---|---|
| 1,768,358 | 6/1930 | Harrison | 204/206 X |
| 2,445,675 | 7/1948 | Lang | 204/209 |
| 2,667,453 | 1/1954 | Murray | 204/28 |
| 3,287,238 | 1/1966 | Latawiec et al. | 204/207 X |
| 3,474,009 | 10/1969 | Wang | 204/35 |
| 3,579,430 | 5/1971 | Lawler | 204/206 |

FOREIGN PATENT DOCUMENTS

| | | | |
|---|---|---|---|
| 7125961 | 7/1971 | Japan | 204/206 |
| 1416512 | 12/1975 | United Kingdom | 204/211 |

OTHER PUBLICATIONS

Metals Handbook 1948 Ed. by Lyman p. 358 pub. by Amer. Soc. For Metals, Cleveland, O. 1948.

*Primary Examiner*—F. C. Edmundson
*Attorney, Agent, or Firm*—Wenderoth, Lind & Ponack

[57] ABSTRACT

Mill scales formed on the surface of a steel wire are continuously removed by causing the wire to pass through a plurality of pairs of electrodes which are connected to an electric power source and arranged in series in an electrolytic cell without contacting the electrodes. This apparatus is applicable in a continuous stretching equipment.

3 Claims, 6 Drawing Figures

APPARATUS FOR CONTINUOUS ELECTROLYTIC DESCALING OF STEEL WIRE WITH MILL SCALES

BACKGROUND OF THE INVENTION

The present invention relates to an apparatus for continuous electrolytic descaling of a steel wire with mill scales and, more particularly, to an apparatus for continuously removing mill scales formed on the surface of a steel wire by an electrolytic pickling by induced current flow method (the term "induced current flow" used herein is to be understood to mean that current flows through a wire without any contact with an electric power source) using a plurality of electrodes, prior to the stretching process in, for example, an apparatus for continuous stretching.

Steel wires (hereinafter referred to as "wire" or "wires") produced in wire plants usually have mill scales formed thereon. These scales are now removed either by a chemical or by a mechanical method. Classified into the chemical descaling methods are pickling, electrolytic pickling and salt bath methods which classified into the mechanical descaling methods are rolling and hot blasting methods. The chemical descaling method (particularly pickling method) usually comprises the steps of pickling, rinsing, coating, and drying. A wire thus descaled is advanced to a stretching process as a secondary process. Each of these steps involves transporation of wires which causes considerable losses in time and labor. Accordingly, various considerations have been made for rationalization of such equipment, particularly for rationalization of the descaling step. In fact, there has been proposed a continuous descaling process by, for example, shot blasting or electrolytic pickling. However, the shot blasting has a disadvantage in that it produces poor adhesion of a lubricant and the electrolytic pickling also has a disadvantage in that its application is limited to rationalization of the descaling step and it is not applicable for the purpose of continuous operation of the entire stretching equipment. Several different types of electrolytic descaling apparatuses adaptable for automation of the entire stretching step have been proposed. However, since most of them adopt a direct current flow method, they have a common disadvantage that lead wires from an electric power source must be brought into direct contact with a wire being processed and cause sparks on the surfaces of the scales of the wire being continuously electrolytically descaled, thereby causing disconnections of the lead wires. The term "direct current flow" used herein is to be understood to mean a system in which electrodes and the wire are connected directly to the electric power source. On the other hand, the term "indirect or induced current flow" used herein is to be understood to mean a system in which a wire (not connected to the electric power source) is disposed with a pair or a plurality of pairs of electrodes which are connected to a direct current power source and the electric current is made to flow through an electrolytic solution.

SUMMARY OF THE INVENTION

Accordingly, an object of the present invention is to provide a reliable apparatus for continuous electrolytic descaling of steel wire capable of preventing problems such as sparks and disconnections of the lead wires.

Another object of the present invention is to provide an apparatus for continuous electrolytic descaling adapted to an apparatus for continuous stretching.

A further object of the present invention is to provide an efficient apparatus for continuous stretching which requires the least possible labor and manual operation.

In the indirect or induced current flow method adopted in an apparatus for continuous electrolytic descaling according to the present invention, lead wires from the anodes of a direct current power source and lead wires from the cathodes of the direct current power source are connected to respective electrodes, and a wire to be processed is made to pass within the electrodes without contact of the electrodes. Accordingly, the wire is unconnected to the electric power source. However, since the electric current flows indirectly through the electrolytic solution in which the wire is immersed, the wire constitutes cathodes at portions opposite the electrodes which are the anodes and likewise constitutes anodes at portions opposite the electrodes which are the cathodes. The rate of current flowing indirectly to the current flowing directly through the circuit (hereinafter referred as "current efficiency") varies depending upon the shapes of the electrodes.

In the indirect or induced current flow method according to the present invention, the heretobefore unavoidable problems, such as disconnections of the lead wires, are completely eliminated and a smooth continuous operation of electrolytic descaling is possible because no direct electric contact is made with the wire which is passing the electrolytic cell at the rate of, for example, 10–150 m/min.

The apparatus for continuous electrolytic descaling according to the present invention has a plurality of pairs of electrodes, one electrode of each pair being connected to the anode of the direct current power source and the other electrode of each pair being connected to the cathode of the direct current power source, which are disposed in series in the electrolytic cell so that the wire will mill scales attached thereon will pass within each of the electrodes. The electrolytic cell is provided with guide rollers for supporting the wire, an entrance and an exit for the wire. Auxiliary cells are disposed adjacent to the entrance and the exit respectively for receiving the electrolytic solution flowing out through the entrance and the exit respectively and for recirculating it into the electrolytic cell, and, when necessary, means for circulating the electrolytic solution within the electrodes at a desired rate as provided.

Another feature of the apparatus according to the present invention is that the electrodes are tube type and/or plate type electrodes so that the wire to be descaled supported by guide rollers of rubber or plastic is caused to pass within each of the electrodes, and a circulating pump and feeding pumps are provided to circulate the electrolytic solution within each of said electrodes at the flow rate of, at least, 0.1 m/sec.

A further feature of the present invention is the provision of the apparatus for continuous electrolytic descaling in the equipment for continuous stretching comprising a roller bender for performing the scale braking process by repeatedly bending the wire having mill scales thereon to thereby give a 1–20% elongation to the wire; an apparatus for continuous electrolytic descaling by the induced current flow method for causing the wire to pass within each of the electrodes of a plurality of pairs in the electrolytic cell; means for rinsing the wire; means for coating the wire with a lubricant; and means for stretching the wire.

BRIEF DESCRIPTION OF THE DRAWINGS

The invention will be better understood from the following description taken in connection with the accompanying drawings in which.

DESCRIPTION OF THE PREFERRED EMBODIMENT

Figure 1:
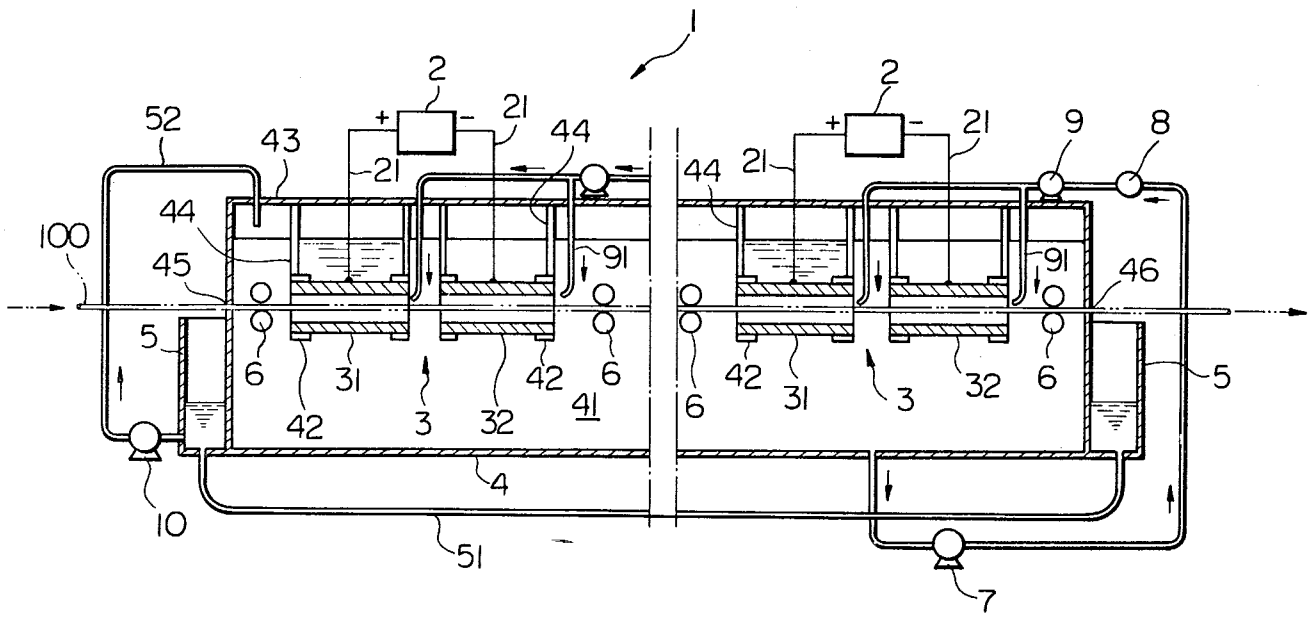
FIG. 1 is a schematic sectional view of the apparatus for continuous electrolytic descaling of steel wire according to the present invention.

Certain preferred embodiments of the present invention will now be described with reference to the accompanying drawings. In FIG. 1, the apparatus for continuous electrolytic descaling 1 according to the present invention comprises, essentially, a direct current power source 2, a plurality of pairs of electrodes 3, an electrolytic cell 4, auxiliary cells 5, guide rollers 6, an electrolytic solution circulating pump 7, an electrolytic solution regenerator 8, feeding pumps 9, and an electrolytic solution returning pump 10.

Figure 2:
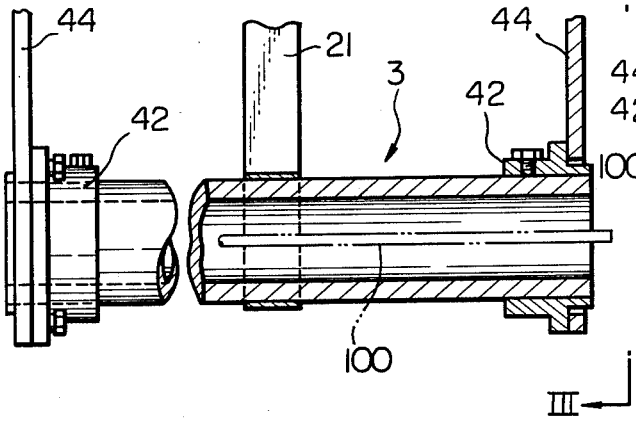
FIG. 2 is a partially broken away side view of an electrode used in the apparatus of FIG. 1.
Figure 3:
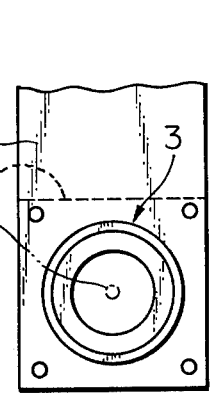
FIG. 3 is a front view seen from the line III—III of FIG. 2.
Figure 4:
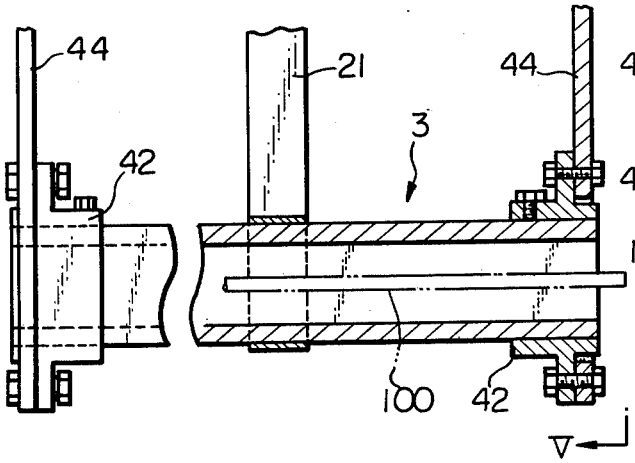
FIG. 4 is a view similar to FIG. 2 showing another embodiment of the electrode.
Figure 5:
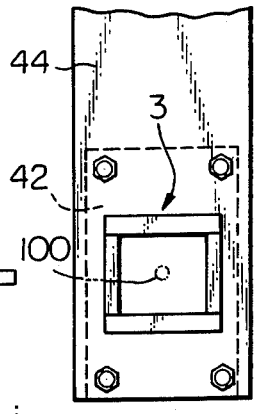
FIG. 5 is a front view seen from the line V—V of FIG. 4.

A pair of the electrodes 3 consists of an anodic electrode 31 connected to the anode (+) of the direct current power source 2 and a cathodic electrode 32 connected to the cathode (−) of the direct current power source 2. The electrodes 3 may be either of the tube type as shown in FIGS. 2 and 3 or of the plate type as shown in FIGS. 4 and 5. The plate type electrodes may consist either of two plate electrodes opposed either vertically or horizontally with spacers of insulating material therebetween or may consist of four plate electrodes assembled into a tube having a square or rectangular section. The tube type electrodes are preferably made to have outside dimensions of: diameter 25–250 mm, length approximately 1000 mm, and thickness 0.5–20 mm. The plate type electrodes are preferably made to have dimensions of: width 1000 mm, length approximately 1000 mm, and thickness of 0.5–20 mm. Experiments have shown that the anodic electrodes 31 may be shorter than the cathodic electrodes 32. (This is presumably due to the fact that the descaling speed is proporational to the quantity of electricity (current density x surface area) which remains unchanged when the length of the electrodes is changed.) The shorter electrodes also provide more advantageous utilization of the space available in the plant.

The electrodes 3 are preferably insoluble in the electrolytic solution which is a solution of a water-soluble neutral metallic salt such as, for example, sodium chloride (NaCl) and sodium sulfate ($Na_2SO_4$) which has a greater ionizing tendency than hydrogen. Therefore, the electrodes are made of such material as titanium, zirconium, tantalum, carbon, or stainless steel. Furthermore, the electrodes may be made of steel in view of its low cost. Since only reductions of $O_2$ and $H^+$ take place at the cathode, tubes or plates of carbon steel may be used as the cathode electrodes in place of the insoluble electrodes.

These electrodes 3 are, as shown in FIG. 1, aligned in series and are suspended in the electrolytic cell 4 filled with an electrolytic solution 41. Each of the electrodes 3 is, as shown in FIGS. 2 or 4, held at opposite ends thereof by holders 42 of an insulating material which are fixed to a support plate 44 suspended from a top frame 43 (see FIG. 1) of the electrolytic cell 4.

Insulated conductors 21 extending from the electric power source 2 are connected electrically to the respective electrodes 3 at the central portions thereof.

The tube type or plate type electrodes 3 have, preferably, only in their inner surfaces exposed, while the outer surfaces are lined with glass or plastic except at the portions where the conductors 21 are connected.

A steel wire 100 of diameter 1–40 mm is, as shown in FIG. 1, introduced into the electrolytic cell 4 through a wire entrance 45 provided in an end wall thereof, passes through the guide rollers 6, and is pulled out of the cell 4 through a wire exit 46 provided in the other end wall thereof. While only one wire is shown passing within each of the electrodes in this embodiment, the apparatus according to the present invention may be constructed so that a plurality of wires may pass within the electrodes at one time.

The guide rollers 6 are made of an acid-resisting material such as rubber, synthetic resin and the like and are arranged in a suitable number along the passage of the wire 100. These guide rollers 6 are provided to prevent the wire from swinging into contact with the inner surfaces of the electrodes 3.

The auxiliary cells 5 are provided at the end walls respectively of the electrolytic cell 4, for receiving the electrolytic solution leaking through the wire entrance 45 or the exit 46. These two auxiliary cells 5 are intercommunicated by means of a connecting pipe 51 so that the electrolytic solution leaking into either of them is returned to the electrolytic cell 4 by the electrolyte returning pump 10 through a conduit 52.

In order to increase the electrolysis efficiency, the electrolyte is preferably circulated forcibly within each of the electrodes 3. For this purpose, the apparatus according to the present invention may be constructed so that the electrolytic solution 41 in the cell 4 is sucked out by the electrolytic solution circulating pump 7, purified by the regenerator 8, increased in pressure by the feeding pumps 9, and then jetted into each of the electrodes 3 from the downstream side thereof through conduit nozzles 91.

Several examples of the relationship between the stretching speed and the number of pairs of the electrodes in the electrolytic cell 4 are shown in Table 1 below.

Table 1

| Diameter of Wire (mm) | Stretching Speed (m/min) | Number of Pairs of Electrodes Required |
|---|---|---|
| 6.6 | 110 | 19 |
| 16 | 45 | 8 |
| 25 | 25 | 4 |

(Tube type electrodes of 1000 mm length were used.)

The plurality of pairs of the electrodes may be connected either in a straight line or in a hairpin loop fashion.

The optimum conditions under which the electrolytic descaling of wire using the apparatus according to the present invention are conducted are: the electrolytic solution to be used is a solution of sodium chloride (NaCl) or sodium sulfate ($Na_2SO_4$), 1–30% pH 0–9, temperature range from room temperature to 95° C.; and the electric current is supplied by an indirect or induced current flowing method. The current efficiency under these conditions is approximately 70% when tube type electrodes are used and approximately 60% when plate type electrodes are used.

The magnitude of the direct current power source for a pair of electrodes must be regulated so as to provide the current density of 50–5000 mA/cm$^2$.

Figure 6:
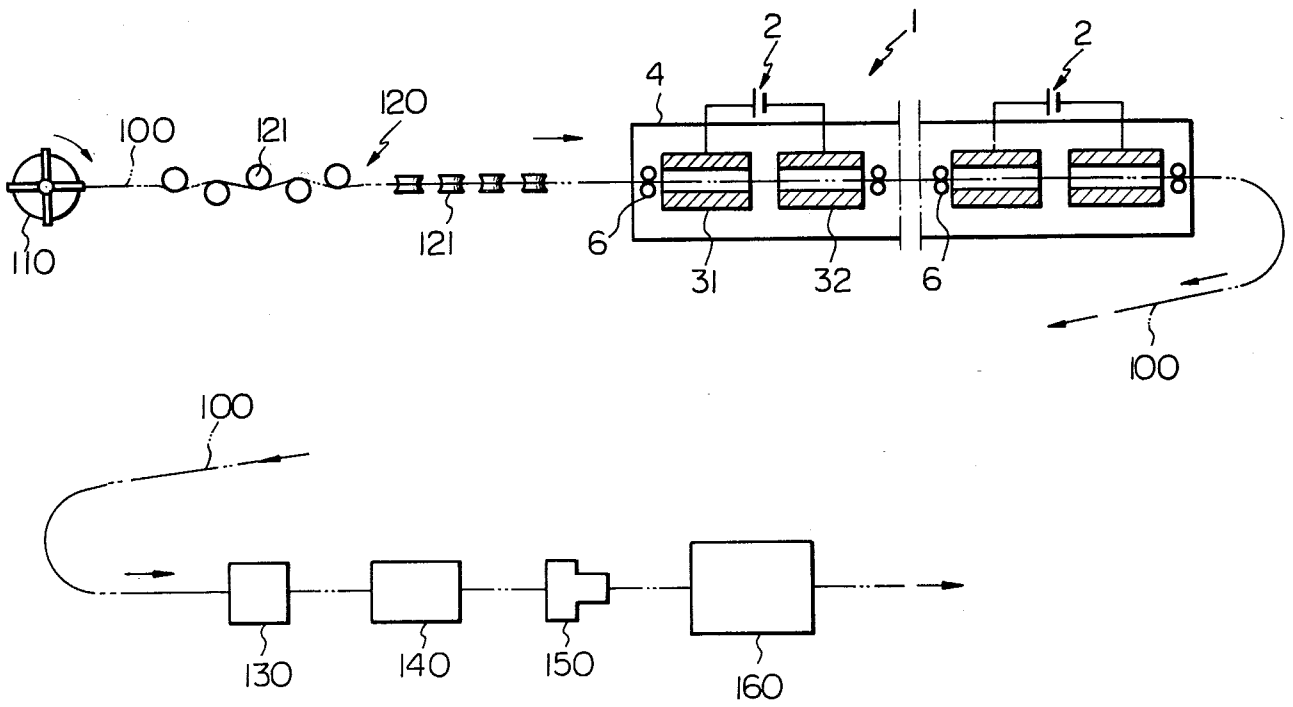
FIG. 6 is a schematic view illustrative of the equipment for stretching incorporating the apparatus shown in FIG. 1.

Referring now to FIG. 6, the continuous stretching apparatus incorporating the continuous electrolytic descaling apparatus according to the present invention will be described. The wire 100 is supplied from a reel 110, advanced through a roller bender 120, and introduced into the abovedescribed continuous electrolytic descaling apparatus 1 in which most of the scales are removed from the surface of the wire 100. The descaled wire 100 is further carried through a washer 130, a lubricator 140 and a drier 150 into a stretcher 160 in which the refined wire 100 is stretched into a final wire product of the desired dimensions.

The roller bender 120 comprises bending rolls 121 disposed above and below and/or right and left with respect to the passage line of the wire for giving a 1–20% elongation to the wire by repeatedly bending it to cause physical cracks on the surface of the wire. This process facilitates the descaling effect in the succeeding step. The passing of the wire rod through the roller bender 120 is an effective step for performing the electrolytic descaling efficiently in a relatively short length of time.

In the washer 130, the electrolytically descaled wire is washed with moving water and brushes to remove sludge, iron rust and electrolytic solution from its surface. The brushes of the washer 130 are preferably of a material such as nylon that will not cause defects on the metal surface. The wire is washed by, for example, two brushes, 100 mm in diameter and 200 mm in length, which rotate with their longitudinal axes parallel to the wire so as to hold the wire therebetween. The rate of rotation of the brushes is preferably in the vicinity of 200 cycles/min.

In the lubricator 140, the wire is coated with a suspension or a paste by which lime of 80–95% in weight and soap of 5–20% by weight are dissolved in an adequate amount of water.

Then, the wire is dried in the drier 150 at a temperature in the range of, for example, from room temperature to 150° C.

Finally, the dried wire is subjected to a stretching operation by the stretcher 160 in which the wire is stretched into a desired length of wire having a diameter of 1–40 mm which is coated with the lime-soap lubricant.

According to the present invention, the electrolytic descaling of the wire is performed continuously without any of the heretofore unavoidable problems, and the entire wire making operation is carried out continuously from the pretreatment by the roller bender to the final stretching operation by the stretcher. Accordingly, the present invention provides distinct advantages in that the descaling and the stretching can be carried out continuously in a mass production system which results in reduced labor, cost and environment pollution.

What is claimed is:

1. An apparatus for continuous electrolytic descaling of mill scales from a steel wire by induced current flow, said apparatus comprising:

roller bender means having a plurality of rolls for reversely bending a wire for at least two cycles of bending for cracking scales on the wire and for drawing the wire for elongating it from 1–20%;

an electrolytic cell adjacent said roller bender means for receiving wire from said roller bender means, said electrolytic cell having a wire inlet therein adjacent said roller bender means and a wire outlet spaced from said wire inlet;

an electrolytic descaling solution in said electrolytic cell;

guide rollers of electrically insulating material within said electrolytic cell for guiding the wire along a line within said cell;

auxiliary cells at said wire inlet and said wire outlet of said electrolytic cell for receiving electrolytic solution leaking through said wire inlet and outlet;

a source of direct electric current;

a plurality of pairs of electrodes in said cell aligned along said line, said electrodes surrounding and being spaced from the wire being guided along said line, one electrode of each pair of electrodes being connected to the anode of said direct current source and the other electrode of each pair being connected to the cathode of said direct current source; and means connected to said electrolytic cell for circulating the electrolytic solution into each of said electrodes at a predetermined rate.

2. An apparatus as claimed in claim 1, in which each of said electrodes in a tube shaped conductor and has substantially the same dimensions as the other electrodes.

3. An apparatus as claimed in claim 1, in which each of said electrodes comprises a pair of spaced opposed electrically conductive plates and means connected between said plates for spacing said plates, each electrode having substantially same dimensions as the other electrodes.

* * * * *